US005178330A

United States Patent [19]

Rodgers

[11] Patent Number: 5,178,330

[45] Date of Patent: Jan. 12, 1993

[54] ELECTROSTATIC HIGH VOLTAGE, LOW PRESSURE PAINT SPRAY GUN

[75] Inventor: Michael C. Rodgers, Indianapolis, Ind.

[73] Assignee: Ransburg Corporation, Indianapolis, Ind.

[21] Appl. No.: 701,798

[22] Filed: May 17, 1991

[51] Int. Cl.[5] ..... B05B 5/03

[52] U.S. Cl. ..... 239/300; 239/707

[58] Field of Search ..... 239/290, 296, 300, 301, 239/690, 707

[56] References Cited

U.S. PATENT DOCUMENTS

| | | | |
|---|---|---|---|
| 1,849,300 | 3/1932 | Jenkins . | |
| 1,982,055 | 11/1934 | Jenkins . | |
| 2,740,670 | 4/1956 | Harder . | |
| 2,864,649 | 12/1958 | Adams | 239/300 |
| 3,093,309 | 6/1963 | Watanabe | 239/15 |
| 3,687,368 | 8/1972 | Geberth, Jr. | 239/15 |
| 3,930,615 | 1/1976 | Farnsteiner | 239/419.5 |
| 4,232,824 | 11/1980 | Binoche | 239/8 |
| 4,341,347 | 7/1982 | DeVittorio | 239/3 |
| 4,531,675 | 7/1985 | Muck | 239/290 |
| 4,744,518 | 5/1988 | Toth | 239/297 |
| 4,761,299 | 8/1988 | Hufstetler et al. | 427/27 |
| 4,765,539 | 8/1988 | Noakes et al. | 239/3 |
| 4,905,905 | 3/1990 | Hufgard | 239/301 |

FOREIGN PATENT DOCUMENTS

| | | | |
|---|---|---|---|
| 313122 | 8/1930 | United Kingdom | 239/301 |
| 2215239 | 9/1989 | United Kingdom | 239/296 |

OTHER PUBLICATIONS

Devilbiss Service Bulletin SB-2-234-A, ©1988, The DeVilbiss Co., Toledo, Ohio.

REA-III Hand Gun Service Manual, Ransburg Electrostatic Equipment, Inc., Indianapolis, IN, Mar. 1985.

90kV R-E-A III Hand Gun Brochure, Ransburg Electrostatic Equipment Inc., Indianapolis, IN, date unknown.

*Primary Examiner*—Andres Kashnikow
*Assistant Examiner*—Karen B. Merritt
*Attorney, Agent, or Firm*—Barnes & Thornburg

[57] ABSTRACT

Easily replaceable pressure reducers are located at the front of the spray gun behind the air and fluid nozzles. These reducers are calibrated and marked for use with a particular air/fluid nozzle combination and maintain ≦10 psig exit air pressure. If the air/fluid nozzle combination is changed, the pressure reducers matched to the new combination are installed at the same time, illustratively using a screwdriver. By designing the air/fluid nozzle combination and pressure reducer as matched sets, the spray gun can always inexpensively be kept in compliance with any requirements under which an HVLP device must operate. "Fan-" or shaping-compressed air driven from the same compressed air which supplies the nozzle air is supplied through an additional pressure reducer valve to reduce its pressure below that of the nozzle air. The fan air reducer employs a drilled orifice of a calculated diameter. The atomizing air reducer is of a needle type that utilizes a controlling outside diameter.

20 Claims, 6 Drawing Sheets

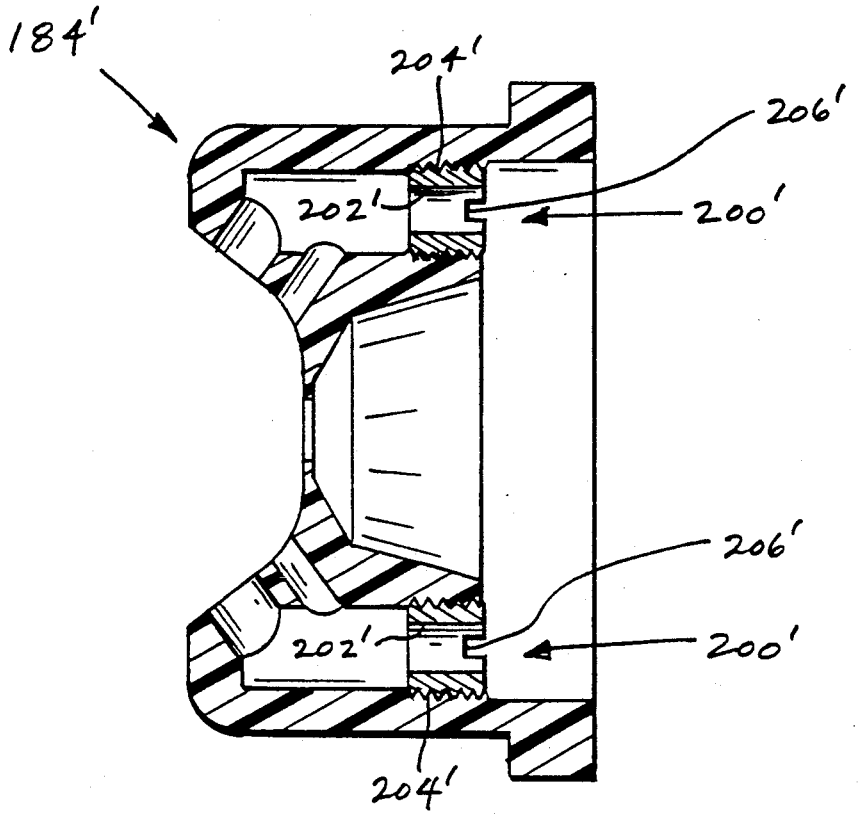
FIG. 8
FIG. 9
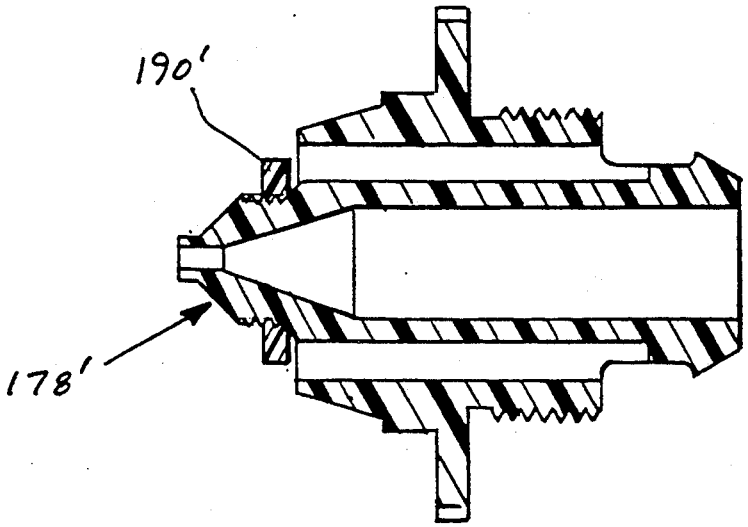

ELECTROSTATIC HIGH VOLTAGE, LOW PRESSURE PAINT SPRAY GUN

BACKGROUND OF THE INVENTION

1. Field of the Invention

This invention relates to so-called high atomizing air volume-low atomizing air pressure, or HVLP, atomizing devices, such as hand-held spray guns. HVLP atomizing devices are defined as those with exit air pressures at or below 10 psig (about 6.9 nt/cm$^2$ gauge).

CROSS REFERENCE TO RELATED APPLICATIONS

The desirability of HVLP atomizing devices is explained in greater detail in U.S. Ser. No. 07/622,853 filed Dec. 6, 1990, now U.S. Pat. No. 5,090623 titled "Paint Spray Gun" and assigned to the same assignee as this application. Reference is here made to that application for its disclosure and particularly for that explanation.

DESCRIPTION OF THE PRIOR ART

Prior to U.S. Ser. No. 07/622,853, HVLP atomizing devices were known. There are, for example, the atomizers described in U.S. Pat. No. 4,761,299 and the prior art mentioned therein, particularly, U.S. Pat. Nos. 4,232,824; 4,341,347; and, 3,093,309. The reader's attention is also directed to, for example, U.S. Pat. No. 4,765,539, which is for the spraying of agricultural chemicals or the like, and to the Ransburg REA ® III atomizing device available from Ransburg Corporation, P.O. Box 88511, Indianapolis, Ind., 46208-0511.

In order for an HVLP device to have an exit pressure at or below 10 psig, two methods of supplying air to the device are used. The first method employs a large and expensive turbine-type compressor that delivers a high volume of air at a low pressure through a large, typically approximately one inch (2.54 cm), diameter hose. The second method employs conventional compressed "shop air" supplied through a small diameter hose. As most shops involved in finishing already utilize compressed shop air, it is far more convenient for the customer, and therefore in the interest of the atomizing equipment supplier, to offer HVLP atomizers that utilize shop air. The obvious problem with employing shop air, however, is that in order to supply a high volume of air to the atomizing device through a small diameter hose, the supply pressure must be high, i.e., between 60 psig and 100 psig (about 41.4 nt/cm$^2$ and 69 nt/cm$^2$ gauge). After this high volume, high pressure air enters the atomizing device, this pressure must be reduced to 10 psig or below. Two devices currently being used to perform this function are needle/venturi pressure reducers and fixed orifice pressure reducers. Needle/venturi pressure reducers are an approach that is both difficult and expensive, and is not tolerant of large fluctuations in supply pressure. The second type of reducer, the fixed orifice, is a very simple approach. A hole of a specific diameter is drilled in the gun body at a point at which air is supplied to the air and fluid nozzles. Both needle/venturi pressure reducers and fixed orifice pressure reducers satisfy the goal of reducing the incoming high air pressure down to a maximum of 10 psig, but in the event that some part of the system is changed, such as changing from an air nozzle with passageways of given sizes to an air nozzle with larger or smaller passageways, both needle/venturi and fixed orifice pressure reducers can permit the pressure to exceed 10 psig. Needle/venturi pressure reducers may require installation of a new needle/venturi. Fixed orifice pressure reducers may require a new gun body. Both of these alternatives are rather expensive.

The invention eliminates the aforementioned problems by using easily replaceable pressure reducers that are located at the front of the spray gun behind the air and fluid nozzles. These reducers are calibrated and marked for use with a particular air/fluid nozzle combination and maintain >10 psig exit air pressure. If the air/fluid nozzle combination is changed, the pressure reducers matched to the new combination are installed at the same time, illustratively using a screwdriver. By designing the air/fluid nozzle combination and pressure reducer as matched sets, the spray gun Can always inexpensively be kept in Compliance with any requirements under which an HVLP device must operate. All air spray guns available today incorporate a "fan" or shaping-compressed air source driven from the same compressed air which supplies the nozzle air. The fan air is supplied through an additional pressure reducer valve to reduce its pressure below that of the nozzle air. The fan air reducer of the present spray gun employs a drilled orifice of a calculated diameter. The atomizing air reducer of the present spray gun is of a needle type that utilizes a controlling outside diameter.

It has been established experimentally that air pressure has a greater influence on atomization quality than does air volume. Because of this, it is desirable to keep the atomizing air pressure as close as possible to the 10 psig figure of merit for HVLP atomization. Adjustment of this fan air pressure valve increases or decreases the width of the spray pattern. In the prior art devices, the 10 psig figure of merit for HVLP atomizing air pressure must be set with no fan air flow. Otherwise the atomizing air pressure can exceed 10 psig under certain operating conditions of the gun, for example, with no fan air flow. Because both the fan and atomizing air are supplied by the same source, a drop in the atomizing air pressure inevitably occurs when fan air flows. All prior art HVLP spray guns of which applicants are aware suffer from this shortcoming. Prior art spray guns can experience as much as a 6 psig (about 4.1 nt/cm$^2$ gauge) drop in the atomizing air pressure when fan air flows. The HVLP spray gun of the present invention incorporates a specially designed fan air valve that reduces the magnitude of this pressure drop to the extent possible. The present invention reduces the magnitude of this pressure drop to about 1–2 psig (about 0.7 nt/cm$^2$ to about 1.4 nt/cm$^2$ gauge).

The fan air valve is designed so that when it is closed a 4 psig (about 2.8 nt/cm$^2$ gauge) bleed (with the spray gun trigger in spraying position) is experienced. 4 psig was chosen as the bleed pressure since pressures over 4 psig begin to affect spray pattern size. This 4 psig bleed permits a higher volume of air to be supplied to the spray gun, while maintaining a predetermined level at the gun inlet. This causes less of a pressure drop to occur in the atomizing air pressure when the fan air valve is opened. Since the atomizing air pressure remains closer to the 10 psig maximum allowable than prior art designs, the atomization quality is greatly enhanced, and the finish quality is higher than that which can be obtained with prior art designs.

SUMMARY OF THE INVENTION

According to the invention, a device for atomizing a first fluid comprises a first passageway for supplying the first fluid, a second passageway for supplying a second fluid for promoting atomization of the first fluid, and a third passageway for supplying the second fluid to promote shaping of a cloud of the atomized first fluid. The second passageway has a first cross-sectional area at an atomizing end of the atomizing device. The third passageway has a second cross-sectional area at the atomizing end of the atomizing device. A nozzle is provided for attachment to the atomizing end of the atomizing device. The nozzle provides adjacent first, second and third openings, a first path for the first fluid therethrough, a first chamber adjacent the first opening of the first path from the nozzle, and a second chamber adjacent the first opening. The second passageway provides atomizing fluid flow to the first chamber. The first chamber is coupled to the second opening to promote atomization of the first fluid as the first fluid exits from the first opening. The third passageway provides shaping fluid flow to the second chamber. The second chamber is coupled to the third opening to promote shaping of the cloud of the atomized first fluid. According to one aspect of the invention, a first orifice-providing member is provided for selective insertion into one of the second passageway and first chamber. The first orifice-providing member provides a first orifice having a cross-sectional area smaller than the first cross-sectional area to reduce the pressure of the atomizing fluid at the second opening.

According to another aspect of the invention, a second orifice-providing member is provided for selective insertion into one of the third passageway and second chamber. The second orifice-providing member provides a second orifice having a cross-sectional area smaller than the second cross-sectional area to reduce the pressure of the shaping fluid at the third opening.

According to yet another aspect of the invention, a means for coupling the second and third passageways to a source of the second fluid includes a first valve member and a first valve seat. The relative positions of the first valve member and first valve seat are adjustable selectively to increase and decrease flow of the second fluid through the third passageway. Means providing a bypass passageway around the first valve seat provides a flow of the second fluid through the third passageway regardless of the relative positions of the first valve member and the first valve seat.

Illustratively, the first orifice-providing member is selectively threadable into one of the second passageway and first chamber.

Further, illustratively, the first orifice-providing member is selectively threadable into the second passageway.

Additionally, illustratively, the first orifice-providing member comprises a first valve needle. The second passageway provides a first valve seat, and the first orifice is defined between the first valve needle and the first valve seat.

Illustratively, the second orifice-providing member is selectively insertable into one of the third passageway and second chamber.

Additionally, illustratively, the second orifice-providing member is selectively threadable into one of the third passageway and second chamber.

Further, illustratively, the second orifice-providing member is selectively threadable into the third passageway.

Additionally, illustratively, the second orifice-providing member comprises a flow reducer sleeve for threading into the atomizing end of the third passageway.

Further, illustratively, the means providing a bypass passageway around the first valve seat comprises means providing said bypass passageway through the first valve body.

BRIEF DESCRIPTION OF THE DRAWINGS

The invention may best be understood by referring to the following detailed description and accompanying drawings which illustrate the invention. In the drawings:

FIG. 8 illustrates an alternative construction of the air nozzle of FIGS. 1–7; and, FIG. 9 illustrates an alternative construction of the liquid nozzle of FIGS. 1–7.

Figure 1:
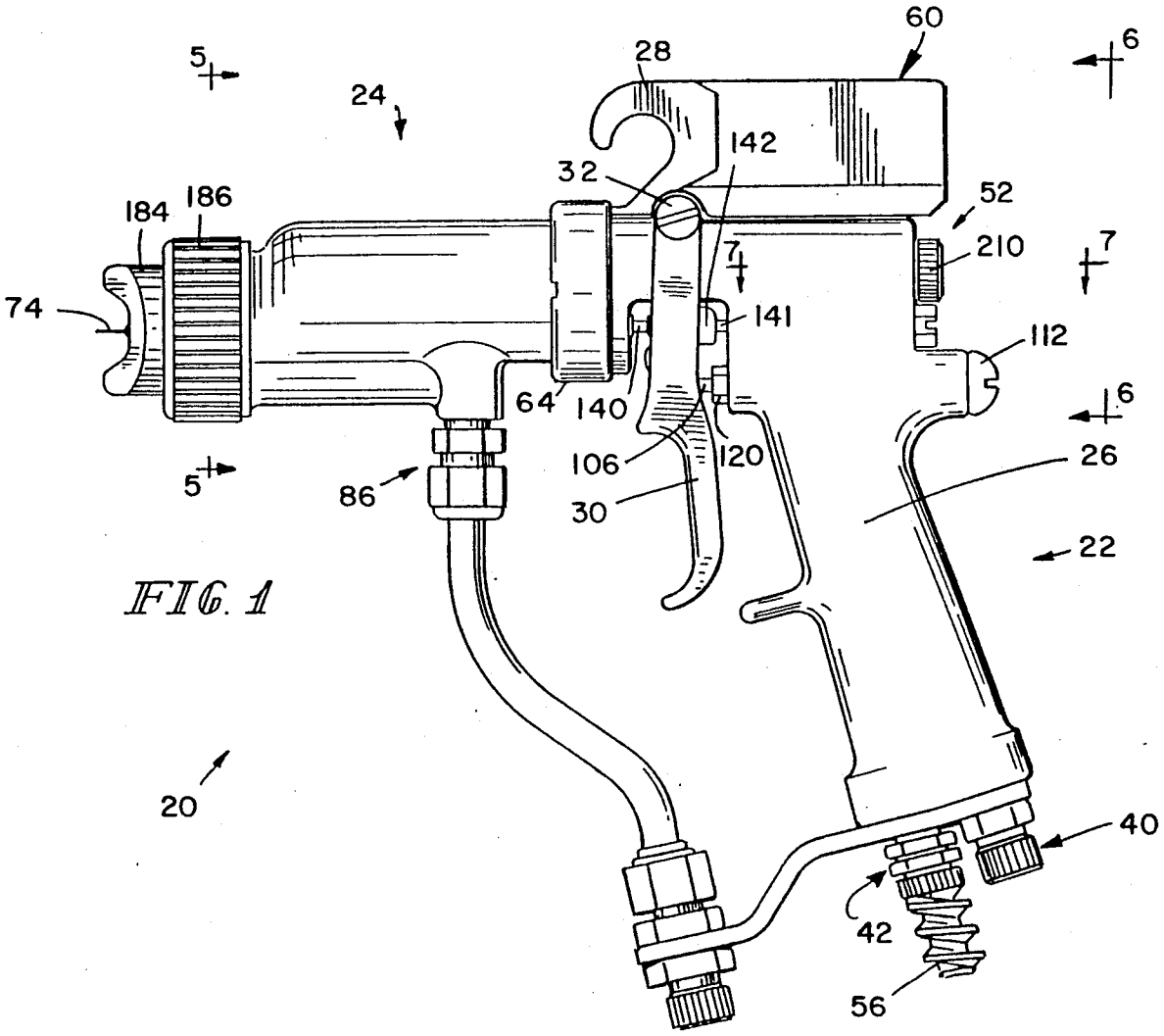
FIG. 1 illustrates a side elevational view of a HVLP hand spray gun constructed according to the invention.

An HVLP hand spray gun 20 according to the present invention includes a handle portion 22 and a barrel portion 24. The handle portion 22 is provided with a hand grip 26 and a hanger hook 28. A trigger 30 is pivotally 32 mounted from the upper region of handle portion 22 and extends downwardly in front of hand grip 26 for easy manipulation by an operator when the operator is gripping hand grip 26. Handle portion 22 is provided with an internal compressed air passageway 36 and a high voltage connector passageway 38, both of which terminate at the lower end of hand grip 26 at connectors 40, 42, respectively.

Air flow through air passageway 36 is controlled by a trigger 30-controlled air valve 44. A controlled air passageway 46 extends upwardly from air valve 44 and intersects a forwardly extending atomizing air passageway 48 and a forwardly extending fan air passageway 50 at the top of handle portion 22. A constant bleed fan control valve assembly 52 at the rear end 54 of fan air passageway 50 controls the supply of fan air forward from valve 52 in a manner which will be described later.

Low magnitude voltage provided through a suitable low voltage cable 56 is supplied through connections (not shown) to a transformer housed in a transformer housing 60 integral with hanger hook 28. The transformer transforms low-magnitude voltage (≦±24V) supplied through cable 56 up to about 5 KV.

Barrel portion 24 is mounted to handle portion 22 by a barrel 24-retaining ring 62 and cooperating barrel-retaining nut 64. A gasket 66 positioned between handle portion 22 and barrel portion 24 seals all of the passageways and connections between these two. Barrel portion 24 includes a high voltage Cascade 68 and electrical connections (not shown) by which it is coupled electrically to the output terminals (not shown) of the high voltage transformer in housing 60. Cascade 68 rectifies and multiplies the approximately 5 KV output voltage variations across the transformer's output terminals up to about −65 KV for application to a liquid coating material charging needle 74 positioned at the front end of gun 20.

Barrel portion 24 also includes an atomizing air passageway 76 which mates with passageway 48 at gasket 66, and a fan air passageway 78 which mates with passageway 50 at gasket 66. Passageways 76, 78 extend forward from gasket 66 to the front end 80 of barrel portion 24 and terminate at threaded openings 82, 84, respectively.

A liquid coating material is introduced into gun 20 through a connector 86 provided on the underside of barrel portion 24 about halfway along the length thereof. Liquid coating material flows upward through connector 86 and then forward through a coating material passageway 88 which extends longitudinally along barrel portion 24 and terminates at the front end 80 of barrel portion 24.

An air valve 44 pushrod 106 extends rearwardly from behind and adjacent trigger 30 into the body of air valve 44. A valve head 108 on the end of pushrod 106 and a compression spring 110 of valve 44 are captured in the valve 44 bore by a threaded air valve cap 112. Seepage of air from the front of the bore 114 accommodating pushrod 106 is minimized by a TEFLON® O-ring 118 held in place by a retaining nut 120 threaded into the forward end of bore 114. Barrel portion 24 includes a central valve needle passageway 130. Passageway 130 includes a reduced diameter extreme forward portion 132 and a larger diameter rearward portion 134. The rearward end 136 of portion 134 is threaded. A needle shaft assembly 138 includes a shaft 140 which extends forward, and a shaft 141 which extends rearward, from a trigger crossbar 142. A collar 144 adjacent the rearward end of shaft 141 provides a stop for a compression spring 146 captured between collar 144 and a valve spring cap 150 threaded into the rear end of a return spring housing 152 which houses spring 146 and the rearward end of shaft 141 including collar 144. A trigger adjusting nut 154 and a trigger adjusting lock nut 156 control the relative timing of the initiation and termination of the air and liquid coating material flows, as will be appreciated.

Shaft 140 extends forward from trigger 30 into passageway 130 through a packing nut 160, a Belville spring washer 162, a seal and spring spacer 164, a rear needle seal retainer 166, a packing adjustment tube 168, a female chevron seal adapter 170, a chevron packing 172, and a male chevron seal adapter 174 to the front end 80 of barrel portion 24.

An internally threaded, central, enlarged opening 176 is provided around the opening of passageway 130 in the front end 80 of barrel portion 24. A coating liquid nozzle 178 is threaded into opening 176. The charging needle 74 and liquid coating material flow control valve needle 180 respectively project from, and seat against, the coating material discharge orifice 182 in nozzle 178. An air nozzle 184 is placed over nozzle 178 and the remaining exposed portions of the front end 80 of barrel portion 24 to define an atomizing air chamber 186 and an atomizing air exit opening 188. Air nozzle 184 is captured on the front end 80 of barrel portion 24 by a retainer ring 186 which threads onto the front end 80 of barrel portion 24.

Figure 2:
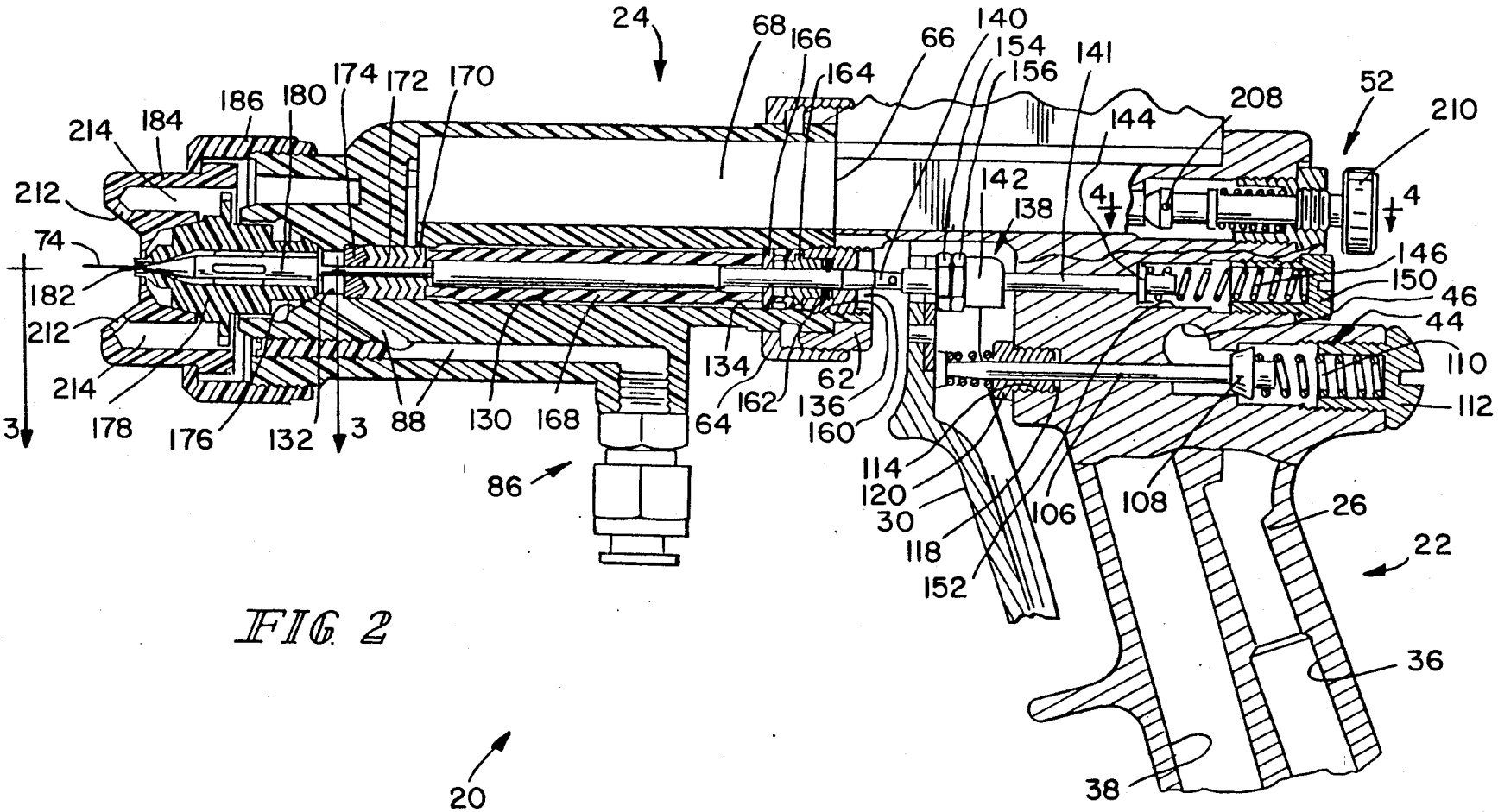
FIG. 2 illustrates a fragmentary longitudinal sectional view of the HVLP hand spray gun illustrated in FIG. 1.
Figure 3:
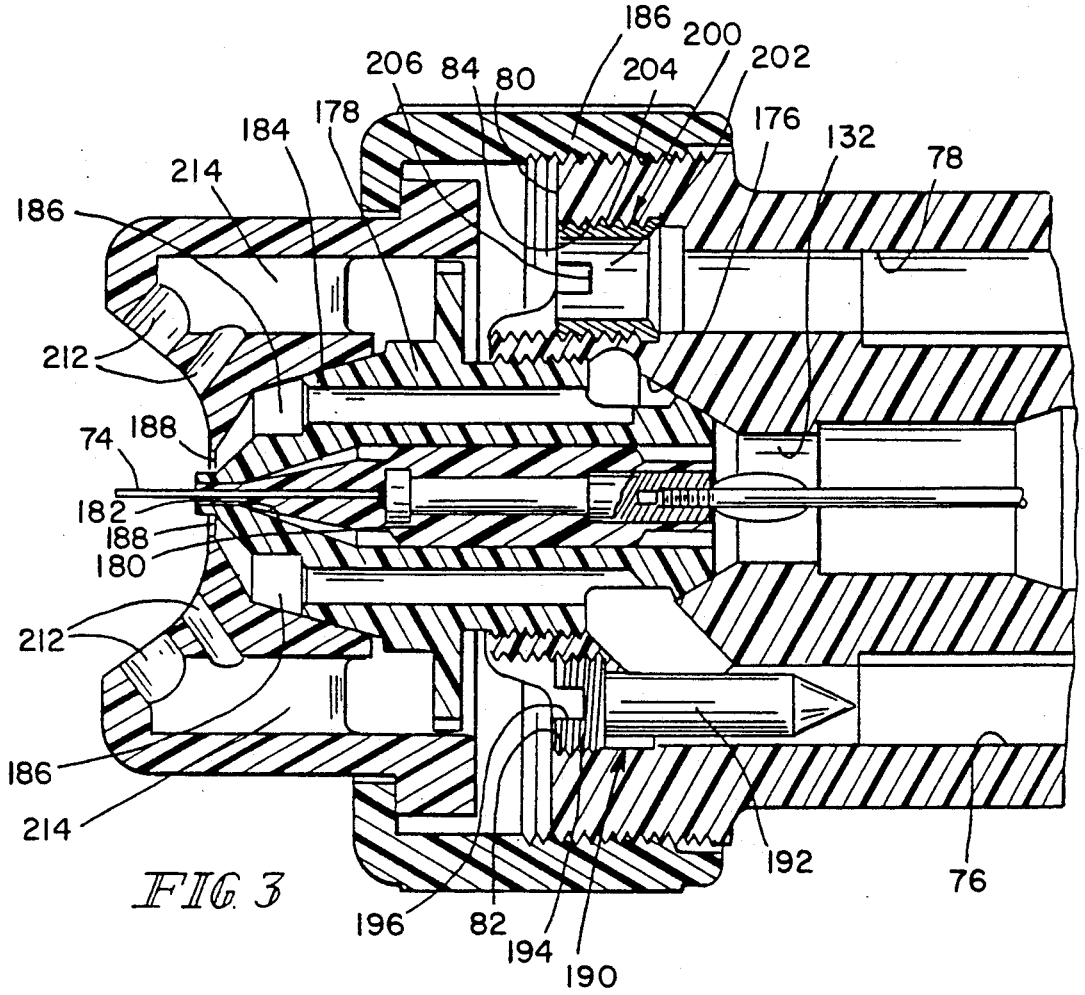
FIG. 3 illustrates an enlarged sectional view of the forward portion of the HVLP hand spray gun illustrated in FIGS. 1–2, taken generally along section lines 3—3 of FIG. 2.
Figure 4:
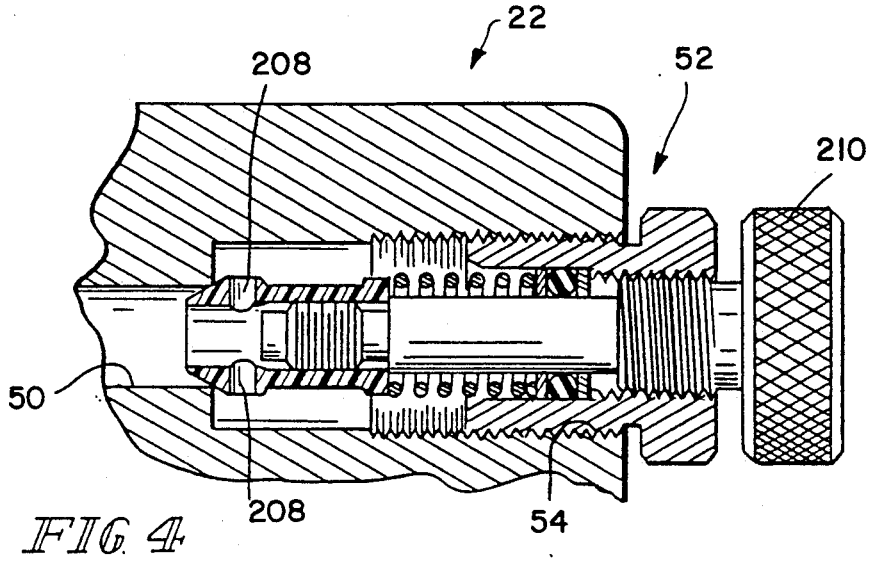
FIG. 4 illustrates an enlarged fragmentary sectional view of the fan air valve assembly of the HVLP hand spray gun illustrated in FIGS. 1–2, taken generally along section lines 4—4 of FIG. 2.
Figure 5:
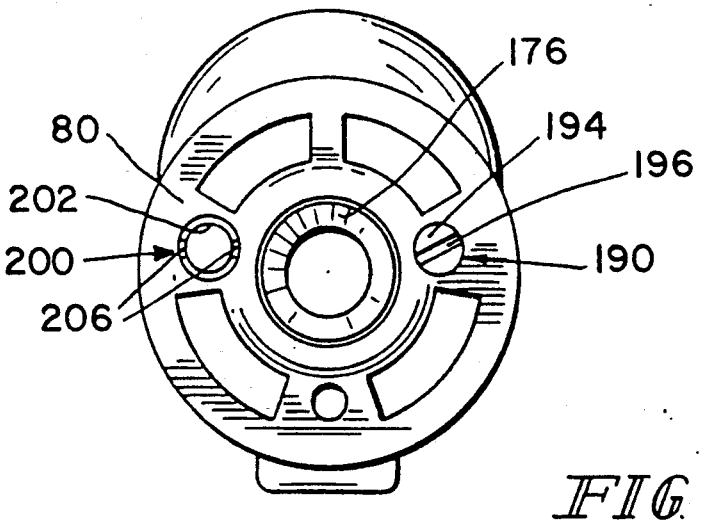
FIG. 5 illustrates a fragmentary sectional view of the HVLP hand spray gun illustrated in FIGS. 1–2, taken generally along section lines 5—5 of FIG. 1, illustrating the front e nd of the gun barre 1 with the air and fluid nozzles re moved.
Figure 6:
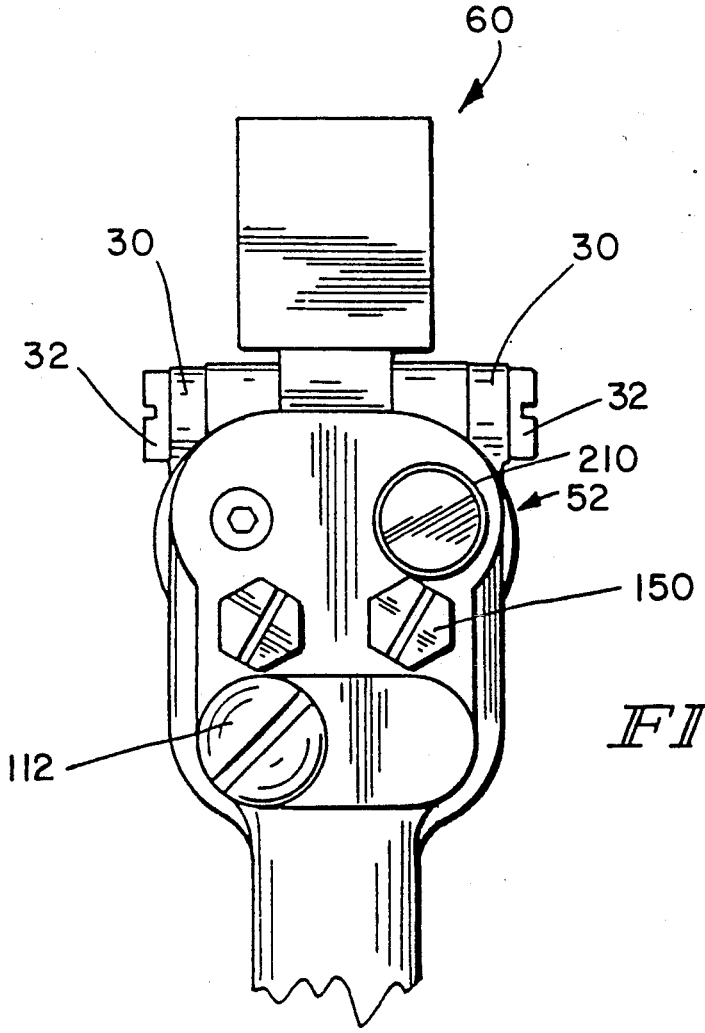
FIG. 6 illustrates a fragmentary view of the HVLP hand spray gun illustrated in FIGS. 1–2, taken generally along section lines 6—6 of FIG. 1.
Figure 7:
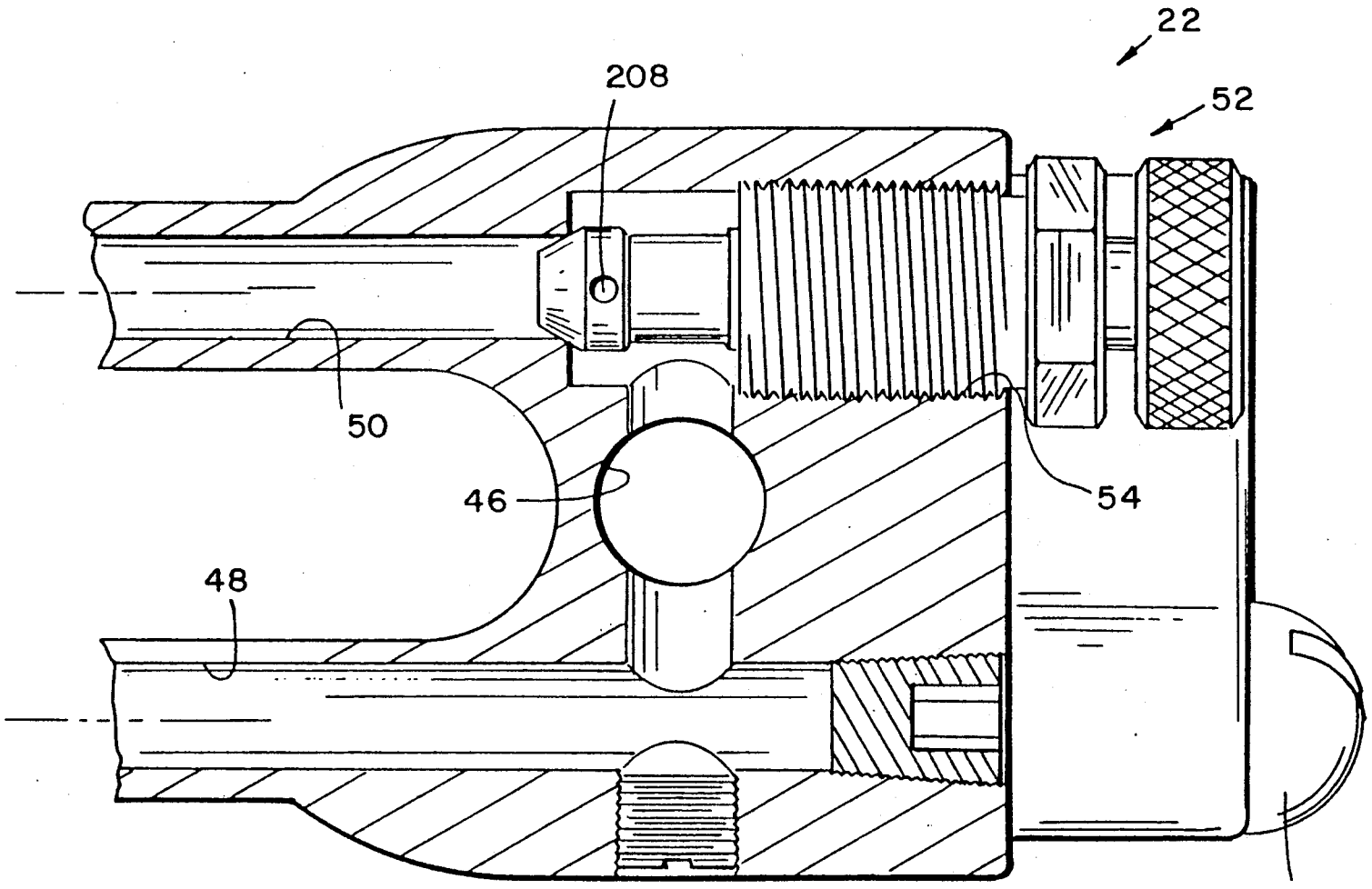
FIG. 7 illustrates an enlarged fragmentary sectional view through the handle of the HVLP hand spray gun illustrated in FIGS. 1–2, taken generally along section lines 7—7 of FIG. 1.

In accordance with the invention, a pressure reducer 190 having a rearwardly extending needle 192 and a threaded 194 and slotted 196 head is threaded into opening 82, and a flow reducer 200 having a central flow control orifice 202, a threaded exterior surface 204 and slots 206, is threaded into threaded opening 84 before liquid nozzle 178 is threaded into opening 176. In an alternative construction illustrated in FIG. 9, a pressure reducer 190' is threaded onto the exterior of liquid nozzle 178' during assembly of the gun. Pressure reducer 190' functions in like manner to pressure reducer 190 in the embodiment of FIGS. 1–7.

In an alternative embodiment illustrated in FIG. 8, flow reducers 200' having central flow control orifices 202', threaded exterior surfaces 204' and slots 206' are threaded into the cavities provided on the backs of the "horns" of an air nozzle 184' before assembly of the liquid and air nozzles onto the front of the gun.

It is known that changes in the configuration of the air nozzle 184 can change the fan- and atomizing air flow dynamics, and therefore, the operating nozzle pressure of guns such as gun 20. The configuration of the illustrated embodiment permits pressure and flow reducers 190, 200 precisely matched to the flow characteristics of a particular air nozzle 184 to be packaged with that air nozzle 184 and supplied with it to the operator. When the operator changes an air nozzle 184, the pressure and flow reducers 190, 200 are changed at the same time, quickly and conveniently, with no more tools than a small screwdriver, to maintain the operating air pressure at nozzle 184 at the 10 psig HVLP maximum.

In order to reduce the sensitivity of the atomizing air pressure at the output side of pressure reducer 190 even further, a bleed pathway 208 is provided through fan air control valve assembly 52. The fan air adjusting knob 210 of assembly 52 is adjustable by screwing it in or out to reduce or increase, respectively, the fan air flow from the fan air openings 212 in air nozzle 184. It is known that the flow which results from fan air openings 212 when the fan air pressure in chamber 214 provided in air nozzle 184 is 4 psig generally does not affect the atomized coating material pattern. Only when the fan air pressure in chamber 214 exceeds 4 psig does the atomized coating material pattern begin to "fan", or be affected in terms of its shape, by the fan air flow. Consequently, bleed ports 208 are provided in the fan control valve 52 which permit the pressure in chamber 214 to be 4 psig, just below the fan air shaping threshold, and air to flow from openings 212 at all times, even when fan air adjusting knob 210 is adjusted all the way in to "close" fan control valve 52. Because this 4 psig bleed exists at all times and the pressure and flow reducers 190, 200 and air nozzle 184 are otherwise designed to account for it, the air pressure on the downstream side of pressure reducer 190 is "buffered" against atomizing air flow rate/pressure variations caused by increasing or decreasing the amount of fan air supplied to chamber 214 by turning fan air adjusting knob 210.

What is claimed is:

1. A device for atomizing a first fluid, the device comprising a first passageway for supplying the first fluid, a second passageway for supplying a second fluid for promoting atomization of the first fluid, the second passageway having a first cross-sectional area at an atomizing end of the atomizing device, and a third passageway for supplying the second fluid to promote shaping of a cloud of the atomized first fluid, the third passageway having a second cross-sectional area at the atomizing end of the atomizing device, a nozzle for attachment to the atomizing end of the atomizing device, the nozzle providing adjacent first, second and third openings and a first path for the first fluid therethrough, a first chamber adjacent the first opening of the first path from the nozzle, the second passageway providing atomizing fluid flow to the first chamber, the first chamber coupled to the second opening to promote atomization of the first fluid as the first fluid exits from the first opening, a second chamber adjacent the first opening, the third passageway providing shaping fluid flow to the second chamber, the second chamber coupled to the third opening to promote shaping of the cloud of the atomized first fluid, and a first orifice-providing member selectively threadable into one of the second passageway and first chamber, the first orifice-providing member providing a first orifice having a cross-sectional area smaller than the first cross-sectional area to reduce the pressure of the atomizing fluid at the second opening.

2. The apparatus of claim 1 wherein the first orifice-providing member is selectively threadable into the second passageway.

3. The apparatus of claim 2 wherein the first orifice-providing member comprises a first valve needle, the first orifice defined between the first valve needle and the second passageway.

4. The apparatus of claim 1 and further comprising means for coupling the second and third passageways to a source of the second fluid including a valve member, a valve seat, the relative positions of the valve member and valve seat being adjustable selectively to increase and decrease flow of the second fluid through the third passageway, and means providing a bypass passageway around the valve seat to provide a flow of the second fluid through the third passageway regardless of the relative positions of the valve member and the valve seat.

5. The atomizing device of claim 4 wherein the means providing a bypass passageway around the valve seat comprises means providing said bypass passageway through the valve member.

6. The apparatus of one of claims 1, 2, 3, 4 or 5 and further comprising a second orifice-providing member for selective insertion into one of the third passageway and second chamber, the second orifice-providing member providing a second orifice having a cross-sectional area smaller than the second cross-sectional area to reduce the pressure of the shaping fluid at the third opening.

7. The apparatus of claim 6 wherein the second orifice-providing member is selectively threadable into one of the third passageway and second chamber.

8. The apparatus of claim 7 wherein the second orifice-providing member is selectively threadable into the third passageway.

9. The apparatus of claim 8 wherein the second orifice-providing member comprises a flow reducer sleeve for threading into the atomizing end of the third passageway.

10. A device for atomizing a first fluid, the device comprising a first passageway for supplying the first fluid, a second passageway for supplying a second fluid for promoting atomization of the first fluid, the second passageway having a first cross-sectional area opening at an atomizing end of the atomizing device, and a third passageway for supplying the second fluid to promote shaping of a cloud of the atomized first fluid, the third passageway having a second cross-sectional area opening at the atomizing end of the atomizing device, a nozzle for attachment to the atomizing end of the atomizing device, the nozzle providing first, second and third openings and a first path for the first fluid therethrough, a first chamber adjacent the first opening of the first path from the nozzle, the second passageway providing atomizing fluid flow to the first chamber, the first chamber coupled to the second opening to promote atomization of the first fluid as the first fluid exits from the first opening, a second chamber adjacent the first opening, the third passageway providing shaping fluid flow to the second chamber, the second chamber coupled to the third opening to promote shaping of the cloud of atomized first fluid, and a first orifice-providing member selectively threadable into one of the third passageway and second chamber, the first orifice-providing member providing a first orifice having a cross-sectional area smaller than the second cross-sectional area to reduce the pressure of the shaping fluid at the third opening.

11. The apparatus of claim 10 wherein the first orifice-providing member is selectively threadable into the third passageway.

12. The apparatus of claim 11 wherein the first orifice-providing member comprises a flow reducer sleeve for threading into the atomizing end of the third passageway.

13. The apparatus of claim 10 and further comprising means for coupling the second and third passageways to a source of the second fluid including a first valve member, a first valve seat, the relative positions of the first valve member and first valve seat being adjustable selectively to increase and decrease flow of the second fluid through the third passageway, and means providing a bypass passageway around the first valve seat to provide a flow of the second fluid through the third passageway regardless of the relative positions of the first valve member and first valve seat.

14. The apparatus of claim 13 wherein the means providing a bypass passageway around the first valve seat comprises means providing said bypass passageway through the first valve member.

15. The apparatus of one of claims 10, 11, 12 or 13 and further comprising a second orifice-providing member for selective insertion into one of the second passageway and first chamber, the second orifice-providing member providing a second orifice having a cross-sectional area smaller than the first cross-sectional area to reduce the pressure of the atomizing fluid at the second opening.

16. The apparatus of claim 15 wherein the second orifice-providing member is selectively threadable into one of the second passageway and first chamber.

17. The apparatus of claim 16 wherein the second orifice-providing member is selectively threadable into the second passageway.

18. The apparatus of claim 17 wherein the second orifice-providing member comprises a second valve needle, the second orifice defined between the second valve needle and the second passageway.

19. A device for atomizing a first fluid, the device comprising a first passageway for supplying the first fluid, a second passageway for supplying a second fluid for promoting atomization of the first fluid, a third passageway for supplying the second fluid to promote shaping of a cloud of the atomized first fluid, and means for coupling the second and third passageways to a source of the second fluid, said coupling means including a first valve member, a first valve seat, the relative positions of the first valve member and first valve seat being adjustable selectively to increase and decrease flow of the second fluid through the third passageway, and means providing a bypass passageway around the first valve seat to provide a flow of the second fluid through the third passageway regardless of the relative positions of the first valve member and the first valve seat.

20. The atomizing device of claim 19 wherein the means providing a bypass passageway around the first valve seat comprises means providing said bypass passageway through the first valve member.

* * * * *